United States Patent [19]

Komatsu et al.

[11] 4,284,124

[45] Aug. 18, 1981

[54] DIE CASTING MACHINE FOR MANUFACTURING HEAT RESISTANT IMPELLERS

[75] Inventors: Mikiya Komatsu; Syuichi Takashima; Syunsuke Suzuki, all of Yokohama, Japan

[73] Assignee: Nissan Motor Co., Ltd., Yokohama, Japan

[21] Appl. No.: 53,324

[22] Filed: Jun. 29, 1979

[30] Foreign Application Priority Data

Jul. 6, 1978 [JP] Japan ..... 53/81415

[51] Int. Cl.[3] ..... B22D 17/12

[52] U.S. Cl. ..... 164/314; 164/343; 425/330

[58] Field of Search ..... 164/113, 312, 314, 315, 164/342, 343; 425/330

[56] References Cited

U.S. PATENT DOCUMENTS 1,943,680 1/1934 Lester ..... 164/315

FOREIGN PATENT DOCUMENTS 702742 2/1941 Fed. Rep. of Germany ..... 164/312

51-1740 1/1976 Japan ..... 425/330

*Primary Examiner*—Robert D. Baldwin

*Attorney, Agent, or Firm*—Silverman, Cass & Singer, Ltd.

[57] ABSTRACT

A die casting machine for manufacturing impellers made of Ni-, Co- or Fe-based heat resistant alloys. A die assembly which is provided with a plurality of radially retractable segments, is coaxially arranged and vertically movable with respect to an injection assembly. Die casting is effected in the lowermost position of the die assembly with the segments closed. The product is ejected out of the machine in the uppermost position of the die assembly with the segments retracted. A short runner minimizes heat dissipation of the molten metal and improves uniformity and quality of the product.

7 Claims, 22 Drawing Figures

DIE CASTING MACHINE FOR MANUFACTURING HEAT RESISTANT IMPELLERS

BACKGROUND OF THE INVENTION

The present invention relates to a die casting machine for manufacturing heat resistant impellers.

A heat resistant impeller, such as an exhaust gas turbine rotor for a supercharger used in combination with an internal combustion engine comprises, as shown in FIGS. 13A and 13B, a boss m and a number of blades n radially projecting from the boss, each of the blades having considerably curved surfaces. Heretofore, such impellers have been manufactured mainly by the lost wax process requiring relatively complex dies. Since such dies cannot be manufactured simply and without consuming substantial time, cost of the product could hardly be reduced. Accordingly, application of metal mold casting or the die cast process has been considered to be superior. The turbine rotor in general has to withstand hot exhaust gas whose temperature amounts to 800° C. Thus, the rotor usually consists of Ni-, Co- or Fe-based metals having a high melting temperature of about 1,400° C., for example. Since the metal mold is subjected to molten metal of such a high temperature, long life of the mold can never be expected. A die cast machine encounters further problems relating to complexity in the shaping of die, arrangement of drive means to open or close the die, as well as the combination of the die and the injection means. Those problems make it difficult to provide commercially applicable die cast machines for such particular purposes.

Turbine rotors or other mechanical components whose rotational speed is high, should be symmetrical with respect to the rotational axis not only in the shape but in the texture of the structure of the material as well. To this end, preferably, molten metal at the time of casting is fed into the die cavity rapidly and symmetrically with respect to the rotational axis, and after completion of casting the molten metal is caused to solidify uniformly and symmetrically with respect to the axis. Otherwise, blowholes are formed within the product, and distribution of the texture of the structure, i.e., of the specific weight and strength, becomes asymmetrical with respect to the rotational axis. With these defects, products capable of withstanding high revolutional speed cannot be obtained.

Referring to FIG. 1, a known die casting machine shown therein for manufacturing impellers by die casting aluminum or ordinary steel comprises: a die assembly including a stationary die a and a movable die b; and an injection assembly including a runner c extending from a chamber e having a gate d, and a plunger f for injecting the molten metal within the chamber e through the runner c into the cavity h formed by the dies a and b. The injection is effected asymmetrically with respect to the axis of the dies or of the product. This known machine encounters the following problems. Firstly, since the distance between the gate d and the cavity h is relatively long, the temperature of the molten metal is liable to be dissipated and reduced while flowing through the runner. In order to maintain its temperature without a substantial decrease, molten metal should be delivered to the die assembly at a relatively high speed. Secondly, however, under such a high speed flow condition, flow of the molten metal would be turbulent by which the dies would get damaged prematurely. Lastly, in order to die cast metals whose melting temperature amounts to 1,400° C., for example, the temperature of the molten metal should be as high as 1,500° C. In contrast to this, even though the dies consist of tungsten or molybdenum alloys, the die should not be heated to more than 300° C. in view of its life. Thus, the difference in temperature between the die and the molten metal amounts to 1,200° C. by which the metal is not cooled and solidified uniformly, and the texture of the texture will not be uniform.

SUMMARY OF THE INVENTION

It is an object of the present invention to provide a novel die casting machine capable of efficiently casting Ni-, Co- or Fe-based heat resistant alloys to produce highly precise and qualified impellers.

It is another object of the present invention to provide a die casting machine having sufficient durability and suitable for manufacturing such heat resistant impellers.

According to the present invention, there is provided a die casting machine for manufacturing heat resistant impellers and comprising a die assembly and an injection assembly. The die assembly is provided with a plurality of die segments displaceable substantially in radial direction with respect to the axis thereof between an inner closed position and an outer open position. The die assembly further is provided with means for causing such displacements of the die segments, the die segments in their inner closed position defining a cavity corresponding to the impellers and a runner communicating with the cavity. The injection assembly is disposed below the die assembly and is provided with an injection sleeve arranged coaxially with the axis of the die segments. A plunger is reciprocably arranged within the sleeve. The injection assembly further is provided with means for driving the plunger. Additional means are provided for displacing the die assembly in the axial direction thereof between an uppermost position in which the die assembly is spaced from the injection assembly permitting molten metal to be poured into the sleeve, and a lowermost position in which the runner defined by the die segments is brought into communication with the interior of the sleeve.

DESCRIPTION OF PREFERRED EMBODIMENTS

Figure 1:
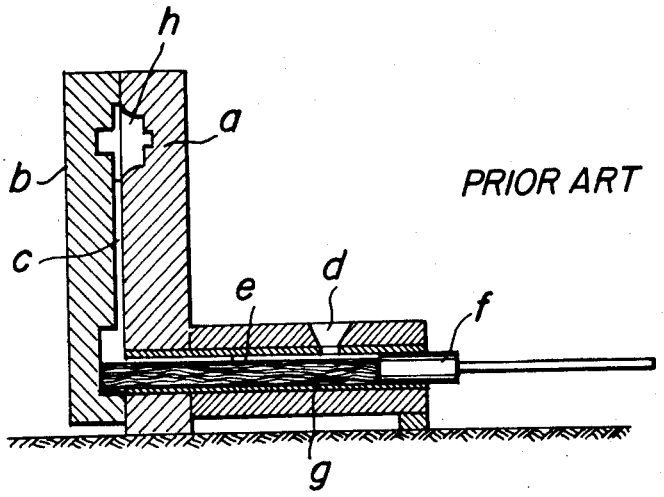
FIG. 1 is a sectional view showing a conventional die casting machine as mentioned above.
Figure 7:
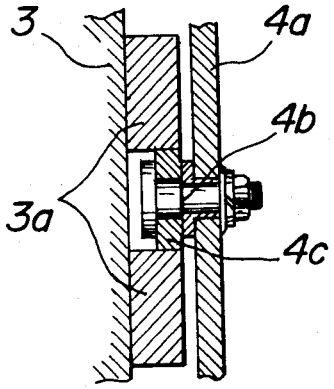
FIG. 7 is a sectional view taken along line VII—VII of FIG. 2.

FIGS. 2 to 6 shows successive operational positions of the die casting machine according to a preferred embodiment of the present invention. The machine comprises an upper die assembly 1 which is adapted to be vertically displaced with respect to an injection assembly 8 disposed below the die assembly 1 in order to effect die casting. Such a vertical displacement of the die assembly 1 takes place by actuating a hydraulic cylinder 2A connected to a linkage 4 whose ram 4*a* is guided by means of vertical guide members provided for a pair of columns 3. More particularly, as shown in FIG. 7, the ram 4*a* on its opposite ends adjacent to the columns 3 bears shafts 4*b* which support rollers 4*c* rotatably. Each of the rollers 4*c* is slidably received within a vertical slot formed in a guide rail 3*a* which is secured to the inner side of the column 3. In this manner, the die assembly 1 is caused to displace vertically along the guide members 3*a* provided for the columns 3 by its driving means or the cylinder 2A and through the linkage 4. In the drawings, 5 denotes a runner, 13 retractable die segments each comprising a cavity forming portion 10, a runner forming portion 11 and a holder 12 for those portions, k a cavity formed when the die segments 13 are closed and having a three dimensional shape identical to that of the product, and l a central axis of the die assembly 1.

The injection assembly 8, which is disposed below the die assembly 1 as stated above, comprises a vertically extending injection sleeve 6 having an open top end 6*a*, and a plunger 7 slidably mounted within the sleeve 6 and caused by means of a hydraulic cylinder 2B to reciprocate in the sleeve 6. The assembly 8 is secured to a bed 9 forming a base structure of the die cast machine with the central axis lp of the plunger 7 substantially coinciding with axis l of the die assembly 1. It is to be noted that as the ram 4*a* is moved into its lowermost position shown in FIG. 3 by actuating the linkage 4, the lower end surfaces 11*a* of the runner forming portions 11 are tightly urged against the upper end surface 6*b* of the sleeve 6, and the injection chamber 26 within the sleeve 6 and the cavity k of the die communicate with each other.

The construction of the machine according to the present embodiment will be individually explained more in detail as follows:

Die Segments

Figure 8A:
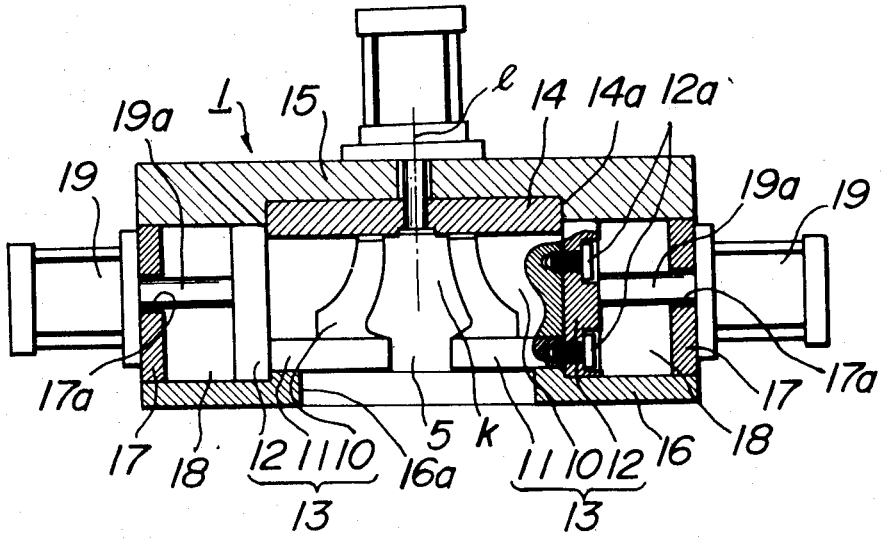
FIGS. 8A and 8B are respectively a sectional view and a partly broken bottom view of the die assembly.
Figure 8B:
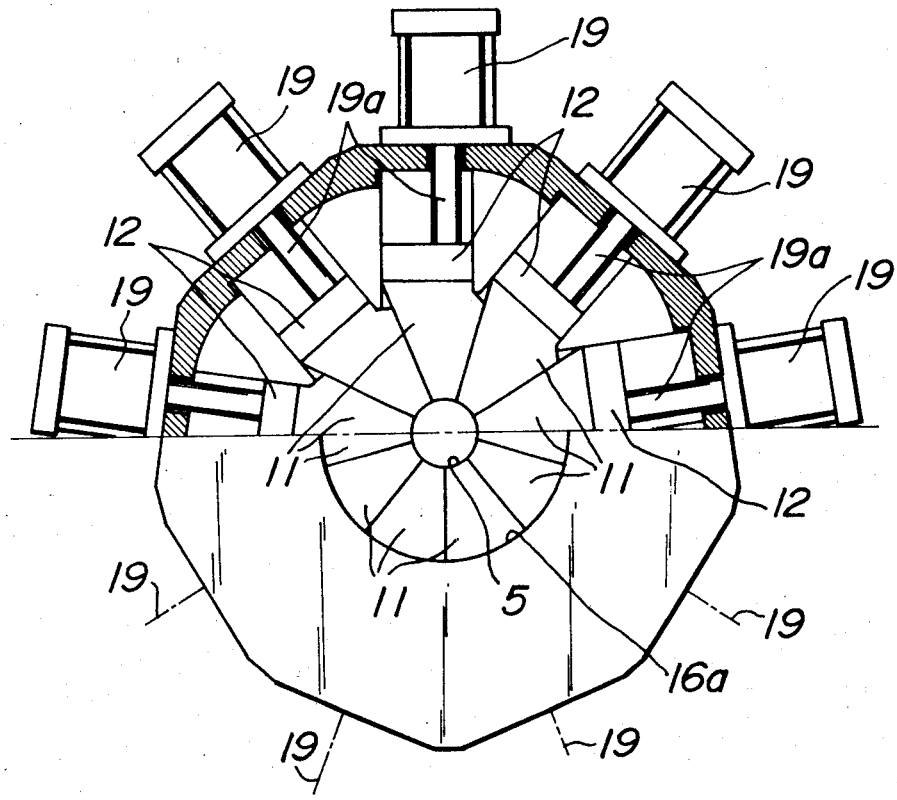

Referring particularly to FIGS. 8A and 8B, the assembly 1 defines a cavity k therein whose shape and size are respectively identical with those of the heat resisting impeller p shown by solid lines in FIG. 13. The center axis l of the assembly 1 corresponds to the rotational axis $l_1$ of the product p. The assembly 1 comprises a plurality of retractable die segments 13 whose number is identical with the number of blades of the product.

For each of the retractable segments 13, the portion 10 for forming the cavity k and having surfaces corresponding to the boss m and the blade n, as well as the portion 11 for forming the runner 5 communicating with the cavity k, are both secured to the holder 12 by means of bolts 12*a*. Each of thus integrated segments 13 is adapted to reciprocate in the radial direction with respect to the center axis l.

Figure 9A:
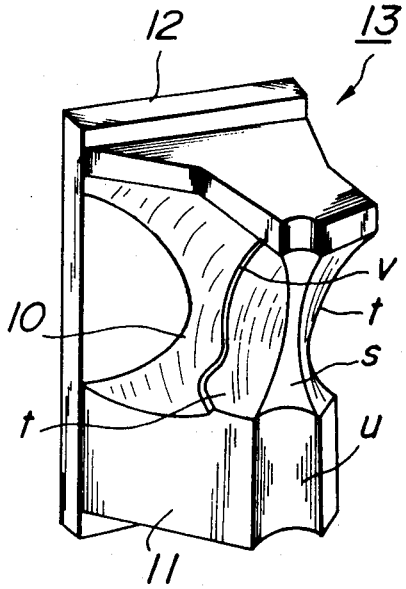
FIGS. 9A and 9B are respectively a perspective view and a side view of one example of a retractable die segment.
Figure 9B:
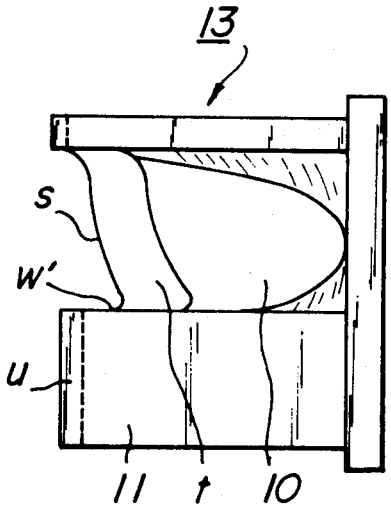
Figure 9C:
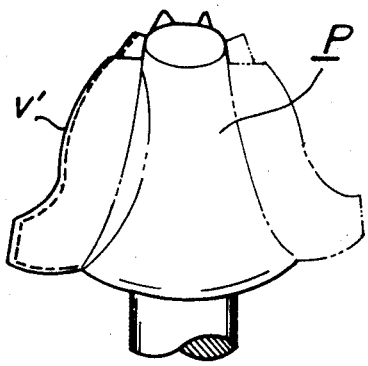
FIG. 9C is a diagrammatic view of an impeller corresponding to the segment shown in FIGS. 9A and 9B.

One example of the retractable segment 13 is shown in FIGS. 9A and 9B as having surfaces s and t respectively corresponding to the boss m and the blade n of the product p, and a surface u corresponding to the runner 5. As is apparent from FIG. 9, portions of the cavity k corresponding to the blades n are formed by each of the pairs of surfaces t which oppose each other when the segments 13 are closed. Each of the segments is formed with a stepped portion v which corresponds to the periphery v′ of the blades as shown in FIG. 9C.

Figure 10A:
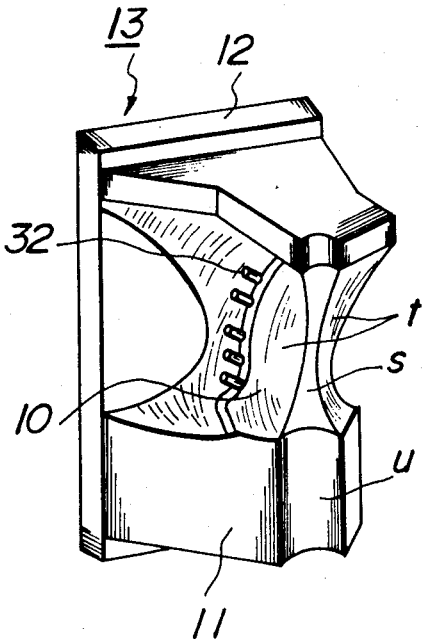
FIGS. 10A and 10B are perspective views of modifications of the die segment.
Figure 10B:
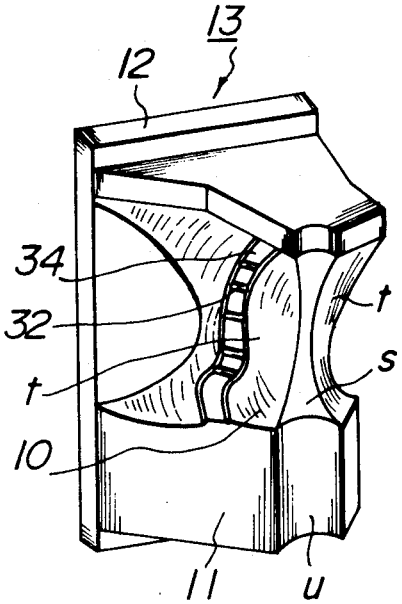
Figure 10C:
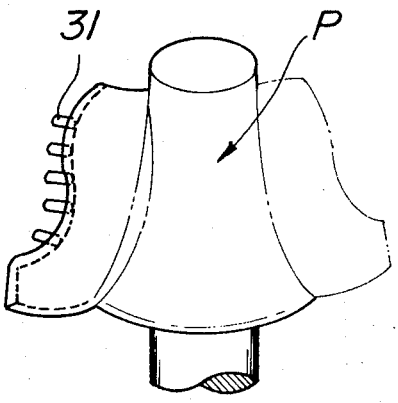
FIGS. 10C and 10D are diagrammatic views of impellers corresponding respectively to the segments shown in FIGS. 10A and 10B.
Figure 10D:
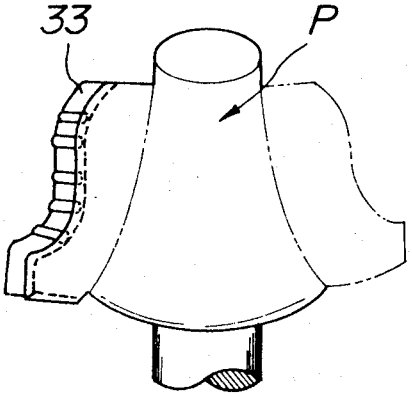

FIGS. 10A and 10B show modifications of the retractable die segment 13. The segment according to those modifications comprises, similarly to that shown in FIGS. 9A and 9B, a cavity forming portion 10, a runner forming portion 11, a holder 12 for those portions, a surface s defining the boss of the impeller, surfaces t each defining a side of the blade of the impeller, and a surface u defining the runner. In order to form rib-shaped projections 31 at the peripheral edges of the blades (FIG. 10C), the segment 13 shown in FIG. 10A comprises recesses 32 which correspond to the projections 31. Further, in order to form flash-like thin-walled portions 33 at the peripheral edges of the blades (FIG. 10D), the segment 13 shown in FIG. 10B is formed with shallow recesses 34 which correspond to the thin-walled portions 33. Further, this segment may additionally be formed with the recesses 32 as shown in FIG. 10A.

The purpose of those recesses 32, 34 will be explained hereinafter.

Figure 13A:
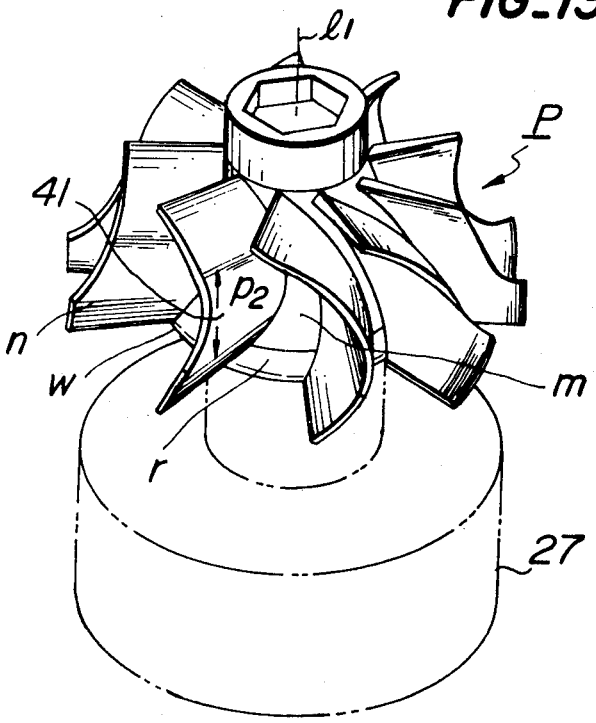
FIGS. 13A and 13B are respectively a perspective view and a longitudinal sectional view of the heat resisting impeller as mentioned above.

In order to produce an impeller having a substantial curvature of the blade, cracks 41 may be formed at the curved portions of the blades (FIG. 13A). This is considered to be owing to the fact that, at the time of solidification and shrinkage of molten metal in the portions of the cavity corresponding to the thin-walled blade portions, the metal is restrained from free shrinkage with respect to the curved portion 10 for forming the cavity thus generating tensile stress $p_2$ at such portions.

Formation of such undesirable cracks 41 can be prevented by means of the die formed with the recesses 32 or 34. Namely, the rib-shaped projections 31 formed by corresponding recesses 32 serve as local resistant elements against the tensile stress generated at the curved surface of the blades, and prevent formation of the cracks by distributing and relaxing the tensile stress at the central part of the curved surface. Further, the thin-walled portions 33 formed by the recesses 34 at the peripheral edges of the blades serve to dislocate the starting point of the cracks outside of the blades, and to ensure that the cracks are formed in the thin-walled portion 33 only, and do not reach the blades or essential parts of the product. By means of a die formed with both types of the recesses 32 and 34, distribution and relaxation of tensile stress by the recesses 32 takes place at the thin-walled portions 33. According to experimental results, it has been found to be preferable that the thickness of the thin-walled portion 33 corresponding to the depth of the recesses 34 be about one half of the peripheral thickness of the blades, and the thickness of the rib-shaped projections 31 corresponding to the depth of the recesses 32, be equal to the peripheral thickness of the blades. Where the recesses 32 only are formed, their depth may be about the same or more than the peripheral thickness of the blades.

Figure 13B:
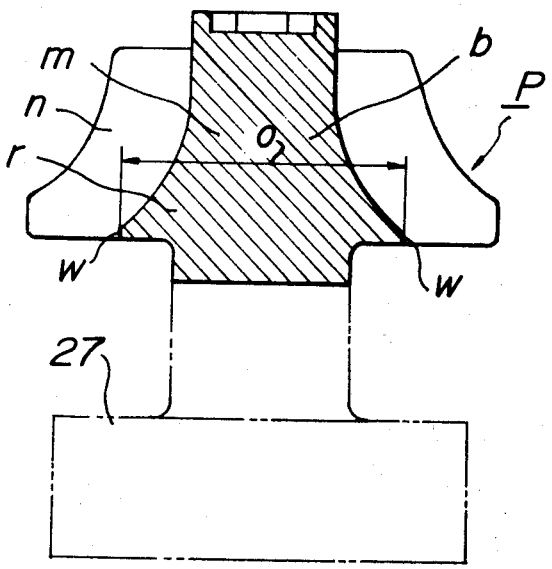

As shown in FIGS. 13A and 13B, the product p at its edge of the large diameter portion r of the boss comprises a sharp corner w. In order to produce such an article by way of die-casting, a corresponding portion w' of the die (FIG. 9B) should be sharp and thin-walled. By this arrangement, however, the portion w' when exposed to high temperature molten metal is liable to become damaged. In view of such a problem, according to the present embodiment, the cavity forming portion 10 and the runner forming portion 11 are formed or assembled as an integral unit so that not only the thin-walled portions are exposed to the molten metal. In this manner, durability of the die is greatly improved.

Die Assembly

As shown in FIGS. 8A and 8B, the retractable die segments 13 are accommodated in a space 18 defined by an upper die 14, an upper die frame 15 on whose lower surface the upper die 14 is secured, a lower die frame 16 formed with a center opening **16*a* having a diameter greater than the maximum diameter 0 of the boss of the product p, and a side wall 17 connecting the frames 15 and 16 together. The die segments 13 are secured to respective ends of piston rods 19*a* extending through bores 17*a* of the side wall 17 into the space 18, and driven by hydraulic cylinders 19 which are radially disposed about the side wall 17 with a pre-determined distance between each other. The cylinders cause the segments to advance into their closed position, and to retract into their open position. The advance of each segment is limited by the engagement of the upper portion of the holder 12 with the periphery 14*a* of the upper die 14. The retraction limits of the segments are so selected that the expansion diameters of the runner forming portions 11 become greater than the maximum diameter 0 (FIG. 13B**) of the boss of the product p.

Figure 11A:
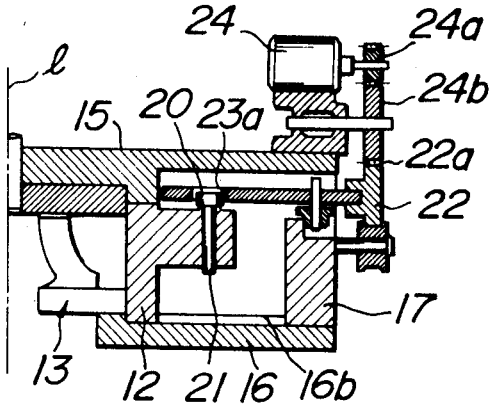
FIGS. 11A, 11B and 11C are respectively a sectional view and bottom view of the drive means for the die segments and the explanatory view of the drive mechanism.
Figure 11C:
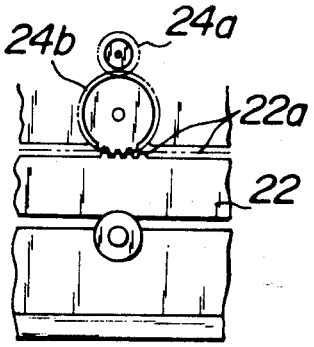
Figure 11B:
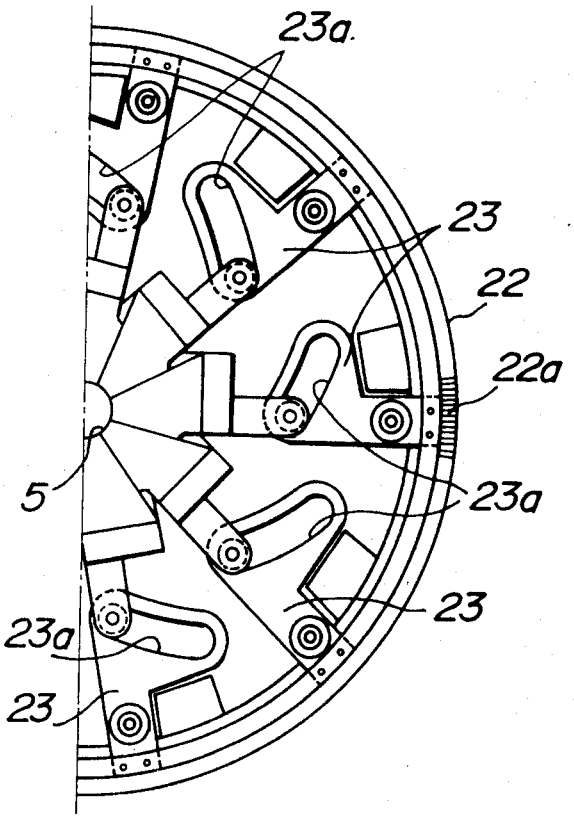

As for the drive means of the retractable segments 13, mechanical means may be used instead of the above-referred hydraulic means. In the example shown in FIGS. 11A to 11C, the holder 12 behind the retractable die segment 13 is formed to be of substantially inverted L-shape. The holder 12 on its horizontal portion is provided with a vertical rod 21 rotatably supporting a guide roller 20. The segments 13 are guided by guide rails **16*b* which are radially disposed, with respect to the center axis l of the die, on the inner surface of the lower die frame 16. A rotatable ring 22 having on its upper surface a rack 22*a* is arranged external of the upper die frame 15. Ring 22 on its inner side is connected to a plurality of cam plates 23 each formed with a cam groove 23*a* engaged by the guide roller 20 of the die segment 13. In order to rotate the ring 22 about its axis by a predetermined angle so as to advance or retract the die segments 13, the rack 22*a* of the ring 22 is connected to a motor 24 secured to the upper die frame 15 through an idle gear 24*b* and a gear 24*a***. The die segments are opened or closed by driving the motor normally or in a reverse direction.

Figure 12:
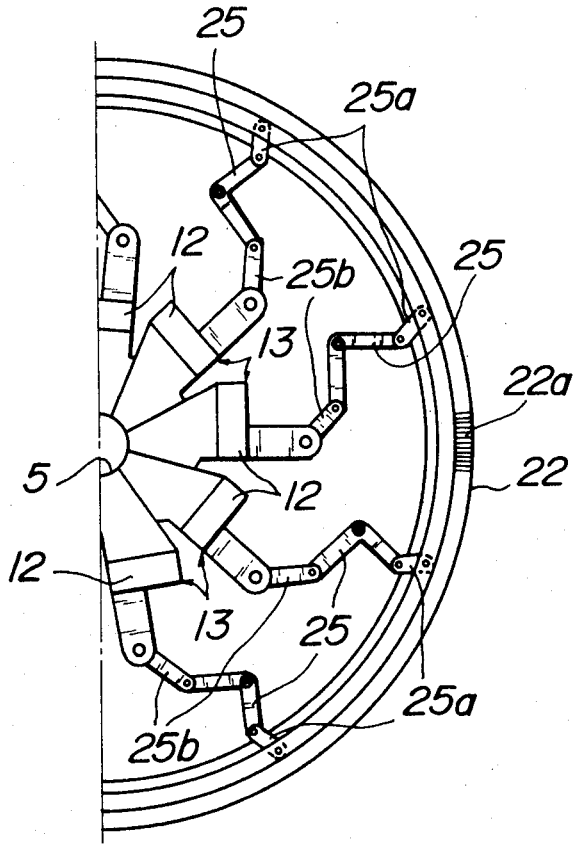
FIG. 12 is a bottom view of modified drive means.

FIG. 12 shows alternative example wherein the die segments are displaced by means of link mechanisms each comprising a first link **25*a* pivoted to the inner side of a rotatable ring 22, a second link 25*b* pivoted to the holder 12 of the die segment 13, and a bell crank 25 connecting the first and the second links and pivoted to the die frame. By this example, too, the die segments are opened or closed by normal or reverse rotation of the ring 22**.

In order to obtain precise shape of the cavity corresponding to the product when the die is closed, and to facilitate ejection of the die cast product, the radial displacement of the die segments with respect to the center axis l of the die must be accurate and positive. This is accomplished by the drive means described above.

Injection Assembly

Figure 2:
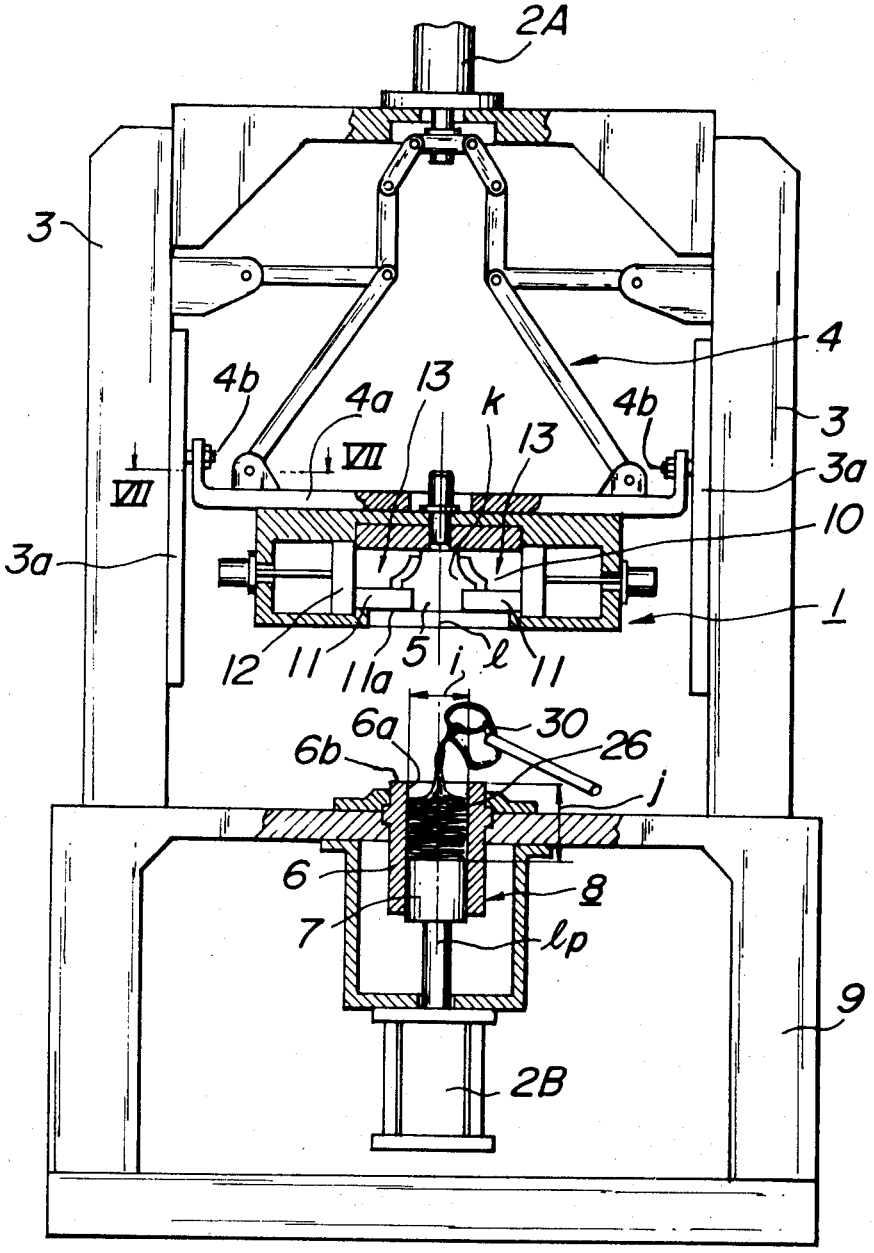
FIGS. 2 to 6 are partly sectional front views of a die casting machine according to a preferred embodiment of the present invention and showing successive operating positions thereof.

Particularly when metals having a high melting point are to be die cast, as in the machine according to the present invention, the temperature of the molten metal poured into the injection sleeve 6 should be prevented from decreasing as far as possible until it is injected into the cavity of the die. Heat dissipation to the injection assembly 8 through components thereof or to surrounding air inevitably takes place more or less, and the shape of the assembly as well as its capacity for the molten metal should be so determined that the temperature of the molten metal will not change significantly. In this respect, the shape of the injection sleeve 6 is selected such that, when the plunger 7 therein is in its lowermost position as shown in FIG. 2, the proportion (i/j) of the inner diameter i of the sleeve to the distance j between the head of the plunger and the top end of the sleeve is from 0.7 to 1.5. With this proportion, the surface area of the molten metal within the sleeve is kept small and the heat dissipation therefrom becomes minimal. Accordingly, the temperature of the molten metal is maintained within a range suitable for a defect free die casting.

The volume of the injection chamber 26 having the above-mentioned proportion is preferably from 2 to 6 times greater than that of the product p. By this arrangement, the temperature of the molten metal can be maintained within a reasonable range, and the yield rate of the cast material can be improved.

Material of the Machine

Referring particularly to FIG. 8, components of the machine which are exposed to the molten metal, namely the upper die 14, the cavity forming portion 10 and the runner forming portion 11 of the die assembly 1, as well as the injection sleeve 6 and the plunger 7 of the injection assembly 8 consist preferably of tungsten alloy having sufficient strength to withstand the high temperature of the molten metal. Such an alloy is known, for example, as ANVILOY 1150 made by Mitsubishi Mallory Metallurgical Co., Ltd., Japan. Besides tungsten alloy, molybdenum and alloys thereof may also be used.

The die cast process of the heat resisting impeller shown in FIGS. 13A and 13B by means of the machine described above will now be explained with reference to FIGS. 2 to 6.

FIG. 2 shows a step wherein molten metal is poured from a ladle 30 into the injection sleeve 6 via its top opening **6*a*, and fills the chamber 26 extending from the opening 6*a* to the top surface of the plunger 7**.

Figure 3:
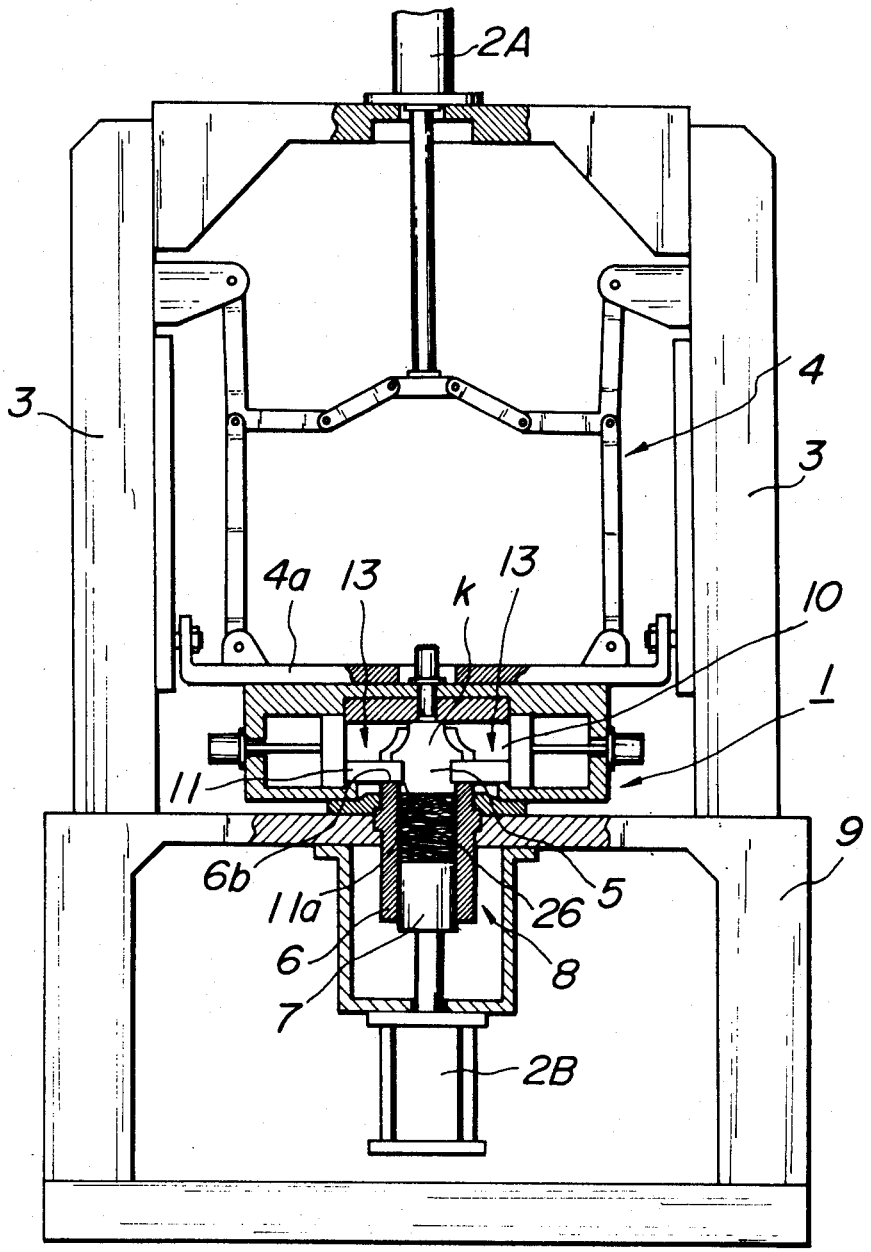

After completion of the pouring, the hydraulic cylinder 2A is actuated to cause displacement of the link mechanism 4, by which the die assembly 1 is caused to move, with respect to the injection assembly 8, toward its lowermost position shown in FIG. 3. In this position, as stated previously, the runner forming portions 11 are tightly urged against the upper end surface **6*b* of the injection sleeve 6**. Further, the retractable die segments 13 are in their advanced or closed positions forming the cavity k corresponding to the impeller, and a runner 5.

Figure 4:
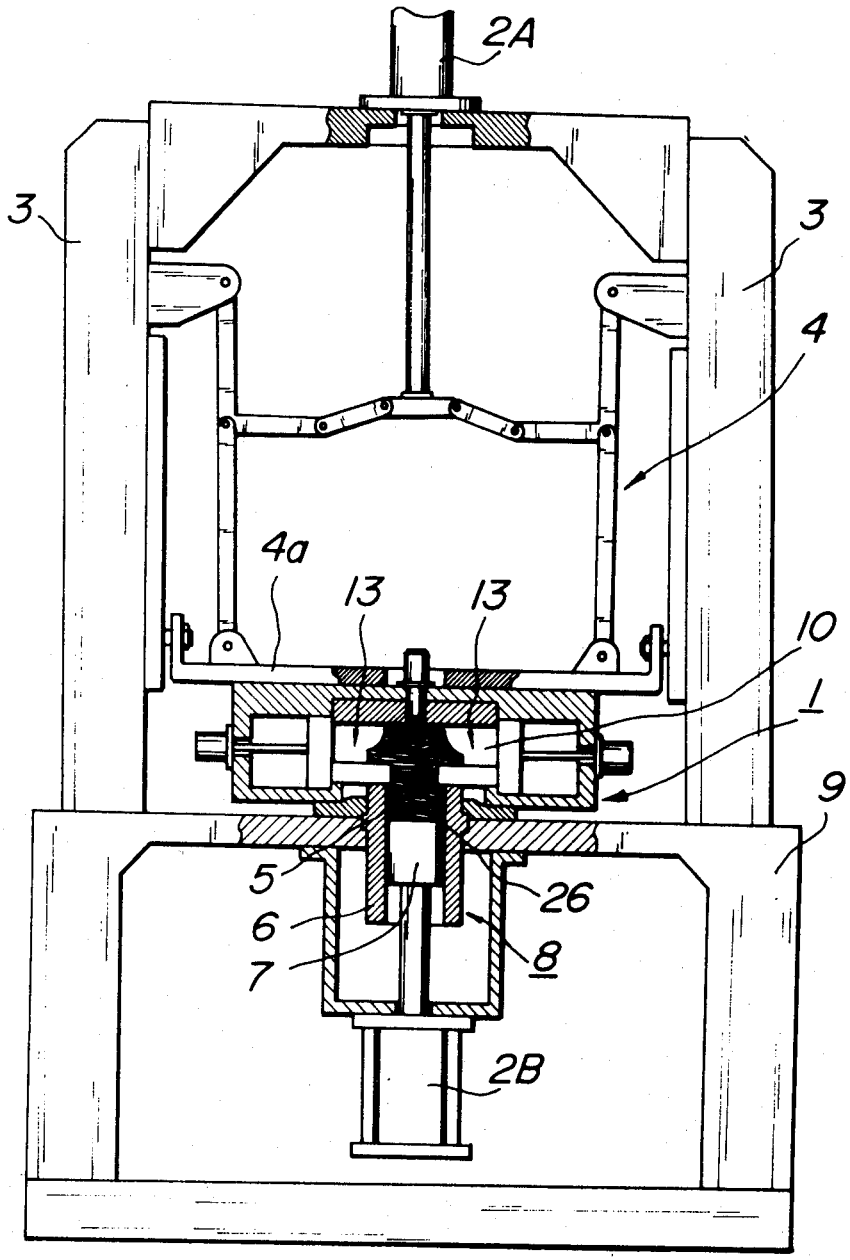

Then, the hydraulic cylinder 2B provided in the injection assembly 8 is actuated to cause an upward axial movement of the plunger 7 within the sleeve 6, so as to force the molten metal within the chamber 26 into the cavity k through the runner 5 (FIG. 4).

This injection step should be carried out as shortly as possible after the pouring step of the molten metal in order to minimize the influence of any temperature drop of the molten metal. It has been found to be favorable to complete the injection step within 6 seconds after completion of the pouring step.

Figure 5:
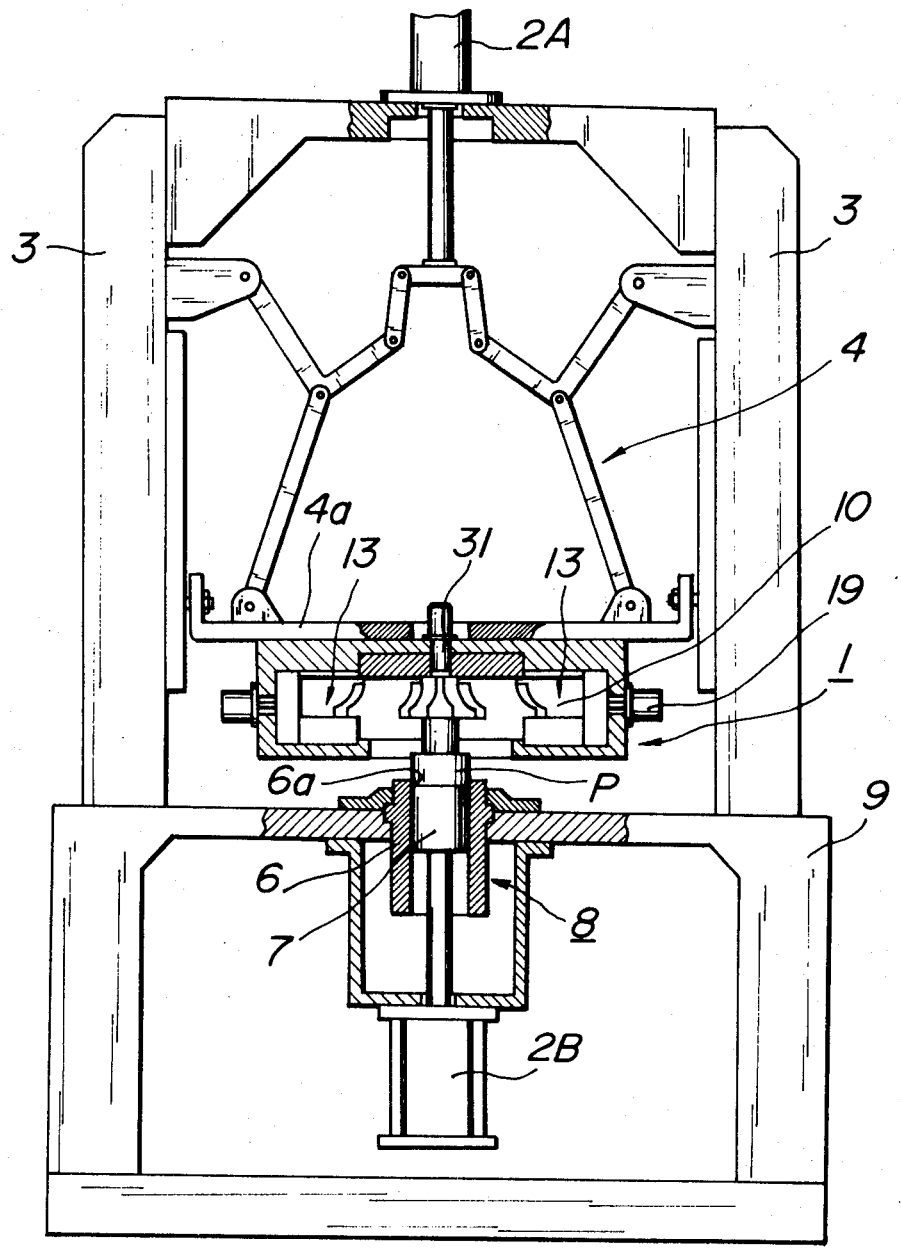

In the subsequent step shown in FIG. 5 wherein the die cast product p after being sufficiently pressed and solidified is to be ejected out of the die, both the upper hydraulic cylinder 2A and the plunger 7 of the injection assembly 8 are actuated upwardly. Just before the product p completely leaves the sleeve 6, the hydraulic cylinders 19 of the die assembly are actuated to retract each of the segments 13. Since the product p at this stage is supported by the upper die 14 at its upper end and by the plunger 7 at its lower end, the segments 13 can readily be retracted without deforming the product p.

Figure 6:
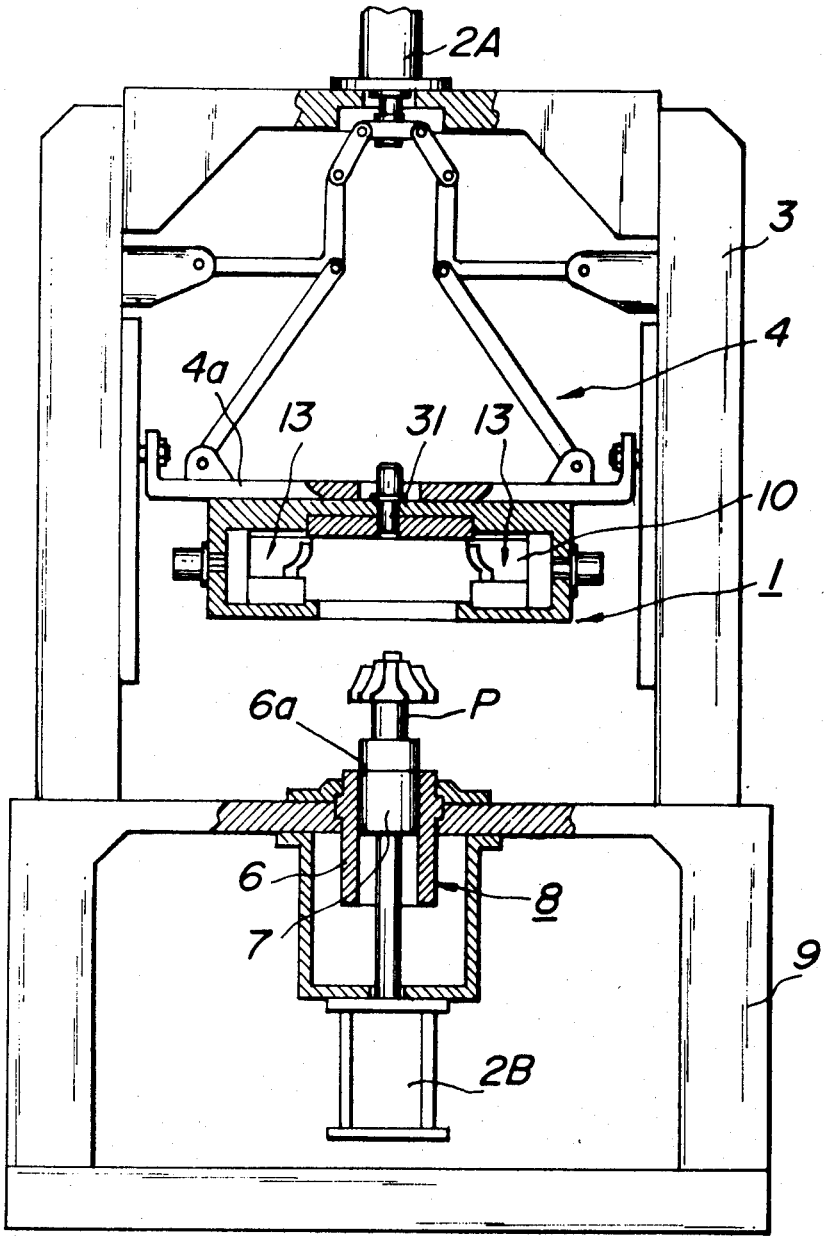

The die assembly 1 is further moved upwardly to the position shown in FIG. 2. The product p at this stage may follow the die assembly 1, or may be left at the top end of the sleeve 6 or the plunger 7 as shown in FIG. 6. This is determined according to the shape of the upper die 14. Namely, when the upper die 14 is of rather complexed shape, the product p preferably follows the upper die 14 and is then separated from the die by actuating an eject pin 31. After ejecting the product p, the eject pin 31, the die segments 13 and the plunger 7 are returned to their initial positions, and one die cast cycle is completed.

Heat resistant impellers without casting defects have been obtained by die casting super heat resisting alloys such as Ni-based Haste Alloy B, Co-based X40 and Fe-based LCN55 according to the process described above under the following conditions:

Weight of the product: 300 g
Weight of the cast metal: 1,000–2,000 g
Casting temperature: 1,600°±25° C.
Die temperature: 200°–300° C.
Casting speed (speed of the plunger): 0.2–0.4 m/s
Casting pressure: 50–200 kg/cm$^2$ According to a further embodiment of the die casting machine of the present invention, the components which are subjected to molten metal, namely the sleeve 6 and the plunger 7 of the injection assembly as well as the die segments 13 of the die assembly 1, consist of silicon nitride compact body, by means of which the above-mentioned three kinds of alloys were die cast. As the result, even though the weight of cast metal was only 2 to 3 times of the weight of the product, running of the molten metal was not disturbed or affected, and products superior in quality were obtained. This is due to the fact that since heat conductivity of the silicon nitride is lower than that of the tungsten alloy, the temperature of the molten metal is more effectively maintained and premature solidification at the thin-walled part of the cavity forming die portion 10 is prevented. Similar advantages can be expected when certain components of the machine consist of, other than silicon nitride, ceramics such as silicon carbide, alumina, zirconia, or cermets consisting of sintered mixtue of ceramics and metals such as 80 wt% $ZrB_2$—50 wt% Mo, 20 wt% $ZrB_2$—80 wt% W, 50 wt% $SiN_4$—50 wt% Mo and the like.

As is apparent from the above description, the machine according to the present invention provides die casting of heat resisting impellers in a short time and with high precision.

Although certain advantageous embodiments have been referred to in the foregoings, it is to be understood that the above description is by way of example only, and is not intended to limit the scope of the present invention.

What is claimed is:

1. A die casting machine for manufacturing a heat resistant impeller having substantially curved blades, comprising:

a die assembly provided with a plurality of die segments displaceable substantially radially with respect to the axis thereof between an inner closed position and an outer closed position, and means for causing such displacements of the die segments, the die segments including cavity forming portions and runner forming portions, while the die segments are in their inner closed position the cavity forming portions defining a cavity and the runner forming portions defining a runner communicating with the cavity, the cavity forming portions of the die segments being formed with first recesses to provide rib-shaped projections extending outwardly from the periphery of the blades of the impeller;

an injection assembly disposed below the die assembly and provided with an injection sleeve arranged coaxially with the axis of the die segments, a plunger reciprocally arranged within the sleeve, and means for driving the plunger; and means for displacing the die assembly axially between an uppermost position in which the die assembly is spaced from the injection assembly to permit molten metal to be poured into the sleeve and a lowermost position in which the runner defined by the die segments is brought into communication with the interior of the sleeve.

2. The machine as claimed in claim 1 in which the cavity forming portion and the runner forming portion of each die segment are integrally formed with one another.

3. The machine as claimed in claim 1 in which the cavity forming portion and the runner forming portion of each die segment are integrally united with one another.

4. The machine as claimed in claim 1 in which the impeller includes a boss portion having a diameter, and while the die segments are in their outer positions the maximum diametrical distance between the runner defining portions of the die segments opposing one another is greater than the maximum diameter of the boss portion of the impeller.

5. The machine as claimed in claim 1 in which the plunger has a diameter and a top end surface and the sleeve has a top end surface adjacent the top end surface of the plunger, such that while the plunger is in a lowermost position, the distance between the top end surfaces of the plunger and the sleeve is about from 0.7 to 1.5 times the diameter of the plunger.

6. The machine as claimed in claim 1 in which while the plunger is in a lowermost position the sleeve and the plunger define a space having a volume, the cavity has a volume and the volume of the space is about from 2 to 6 times the volume of the cavity.

7. The machine as claimed in claim 1 with the cavity forming portions of the die segment being formed with second shallow recesses to provide flash-like, thin walled projections extending outwardly from the periphery of the blades of the impeller.

* * * * *